US007611359B2

(12) United States Patent
Tomizu et al.

(10) Patent No.: US 7,611,359 B2
(45) Date of Patent: Nov. 3, 2009

(54) CONNECTOR DEVICE

(75) Inventors: Motoyuki Tomizu, Okayama (JP); Atsushi Yokoigawa, Okayama (JP); Hideki Kyofuka, Akaiwa (JP); Seiji Goto, Okayama (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 11/881,610

(22) Filed: Jul. 27, 2007

(65) Prior Publication Data

US 2008/0026622 A1 Jan. 31, 2008

(30) Foreign Application Priority Data

Jul. 28, 2006 (JP) ..... 2006-206609

(51) Int. Cl.
*H01R 12/00* (2006.01)

(52) U.S. Cl. ..... 439/74

(58) Field of Classification Search ..... 439/74, 439/345, 347, 375–376
See application file for complete search history.

(56) References Cited

U.S. PATENT DOCUMENTS 4,762,504 A * 8/1988 Michaels et al. ..... 439/345
4,812,133 A 3/1989 Fleak et al.
4,875,873 A * 10/1989 Ishizuka et al. ..... 439/347
7,322,846 B2 * 1/2008 Camelio ..... 439/352
2003/0181083 A1 * 9/2003 Kozono et al. ..... 439/152

FOREIGN PATENT DOCUMENTS

JP 2005-93270 4/2005

OTHER PUBLICATIONS

English abstract of JP2005093270 published Apr. 7, 2005, Data supplied from the esp@cenet database, 1 page.

* cited by examiner

*Primary Examiner*—Jean F Duverne
(74) *Attorney, Agent, or Firm*—Osha • Liang LLP

(57) ABSTRACT

A small connector device having large adjusting amount and satisfactory assembly workability, in which a plug fits into and electrically connects to a socket, includes a socket main body and a socket cover attached to an attachment substrate. The socket main body and the socket cover are respectively assembled to the attachment hole of the attachment substrate from opposite directions to sandwich the attachment substrate by a collar part of the socket main body and a collar part of the socket cover, and the socket main body and the socket cover are slidably supported in an integrated manner.

8 Claims, 16 Drawing Sheets

CONNECTOR DEVICE

BACKGROUND OF THE INVENTION

1. Field of the Invention

The present invention relates to a connector device, for example, a connector device for electrically connecting electrical equipments incorporated in a pinball or pachinko game machine.

2. Description of the Related Art

Conventionally, for example, a self-aligning connector is known for the connector device. (see Japanese Patent Application Laid-Open No. 2005-93270).

A self-aligning connector is proposed in which a connector guide member 10 including a plate spring 19 is play-fit attached to a hole 91 of a panel 90 so as to be movable in the inserting direction and a plug connector housing 20 is play-fit attached to the connector guide member 10 so as to be movable in a direction intersecting the inserting direction.

However, in the connector device described above, the position adjustable range in the direction intersecting the inserting direction is only the gap between an inner flange 14 and an elastic attachment strip 24, as shown in FIG. 5 of Japanese Patent Application Laid-Open No. 2005-93270, and thus the adjusting amount is small and assembly workability is not satisfactory. The floor area of the connector guide member 10 must be increased when attempting to increase the adjusting amount, which enlarges the device.

SUMMARY OF THE INVENTION

In view of the above problems, the present invention aims to provide a small connector device having a large adjusting amount and satisfactory assembly workability.

In order to overcome such problem, a connector device according to the present invention is a connector device for fitting and electrically connecting a plug to a socket including a socket main body and a socket cover attached to an attachment substrate, wherein the socket main body and the socket cover are assembled from opposite directions to an attachment hole of the attachment substrate to sandwich the attachment substrate by a collar part of the socket main body and a collar part of the socket cover, and the socket main body and the socket cover are slidably supported in an integrated manner.

According to the present invention, the socket main body and the socket cover can be integrally sled and position adjusted even if the attachment accuracy of the plug is low since the socket main body and the socket cover engaged and integrated by way of an attachment hole of an attachment substrate are integrally slidable, and assembly workability becomes satisfactory. In particular, since position is adjustable by a gap between the attachment hole of the attachment substrate and the socket, the socket itself does not need to be enlarged, and a connector device smaller than in the prior art is obtained.

According to an embodiment of the present invention, the socket main body and the socket cover are removably engaged and integrated from opposite directions to an attachment hole of the attachment substrate to sandwich the attachment substrate by a collar part of the socket main body and a collar part of the socket cover, and the socket main body and the socket cover are slidably supported in an integrated manner.

According to the present embodiment, one-touch attachment becomes possible by assembling the socket main body and the socket cover in a removably engaging and integrating manner, whereby a connector device of more satisfactory assembly workability is obtained.

According to another embodiment of the present invention, a plurality of positioning projections contacting at least one surface of the attachment substrate is arranged in a projecting manner on the collar part of the socket main body and/or socket cover.

According to the present embodiment, the coefficient of friction becomes small since the positioning projections arranged on the collar part of the socket main body and/or the socket cover point contact the attachment substrate, whereby the socket smoothly slides and the assembly workability further enhances.

According to another embodiment of the present invention, the socket is slidably attached to an attachment plate arranged on a front surface of a pinball game machine main body and a plug is attached to a rear surface of a game board arranged on the front surface side of the attachment plate at a position facing the socket, and the plug is fitted into and electrically connected to the socket.

According to the present embodiment, the assembly work of the pinball game machine is facilitated, skilled person is not necessary, and the assembly workability at the site is enhanced.

According to another further embodiment of the present invention, the socket is slidably attached to an attachment plate arranged on a rear surface of a pinball game machine main body and a plug is attached to a ball discharging unit arranged on a rear surface side of the pinball game machine main body at a position facing the socket, and the plug is fitted into and electrically connected to the socket.

According to the present embodiment, the assembly work of the pinball game machine is facilitated, skilled person is not necessary, and the assembly workability at the site is enhanced similar to the previous embodiment.

DETAILED DESCRIPTION OF THE PREFERRED EMBODIMENTS

Embodiments of the present invention will now be described with reference to the accompanying drawings FIGS. 1 to 16.

Figure 1:
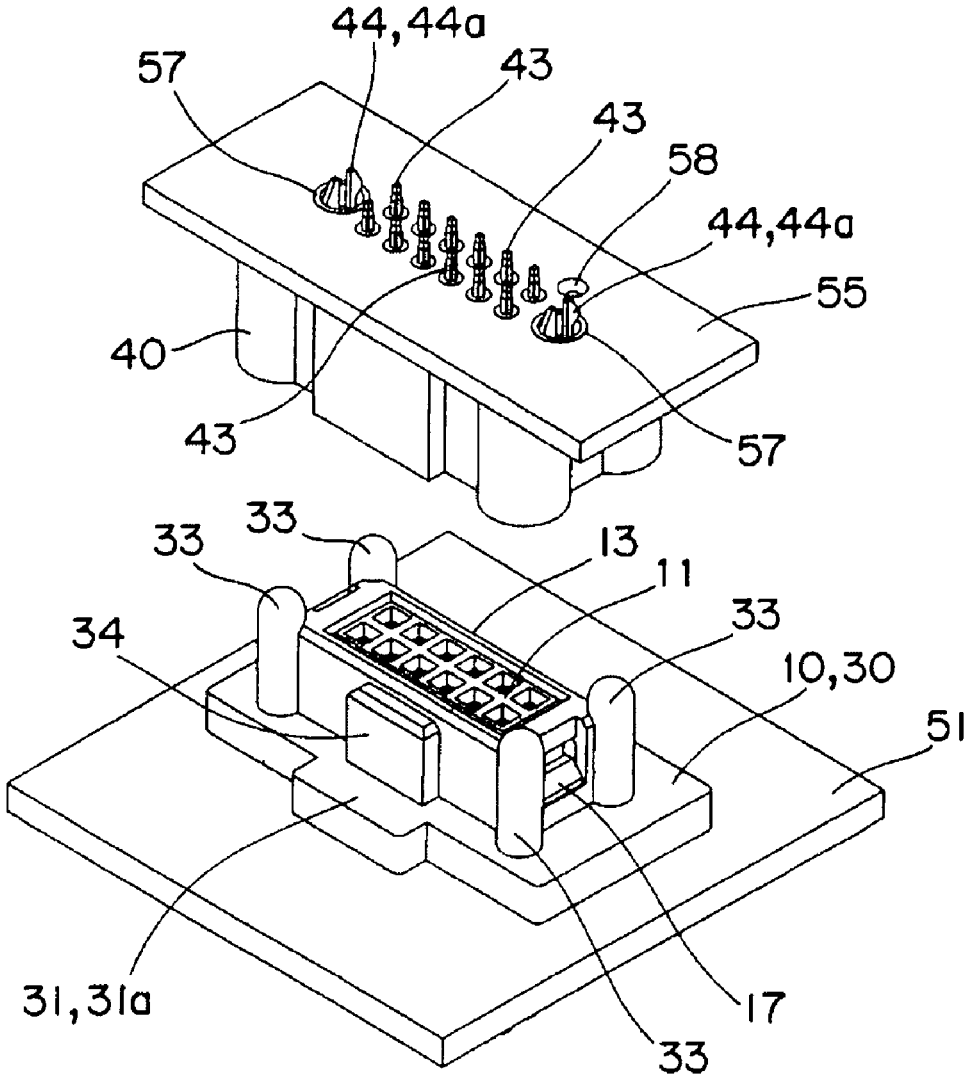
FIG. 1 shows a perspective view showing a first embodiment of a connector device according to the present invention.
Figure 2:
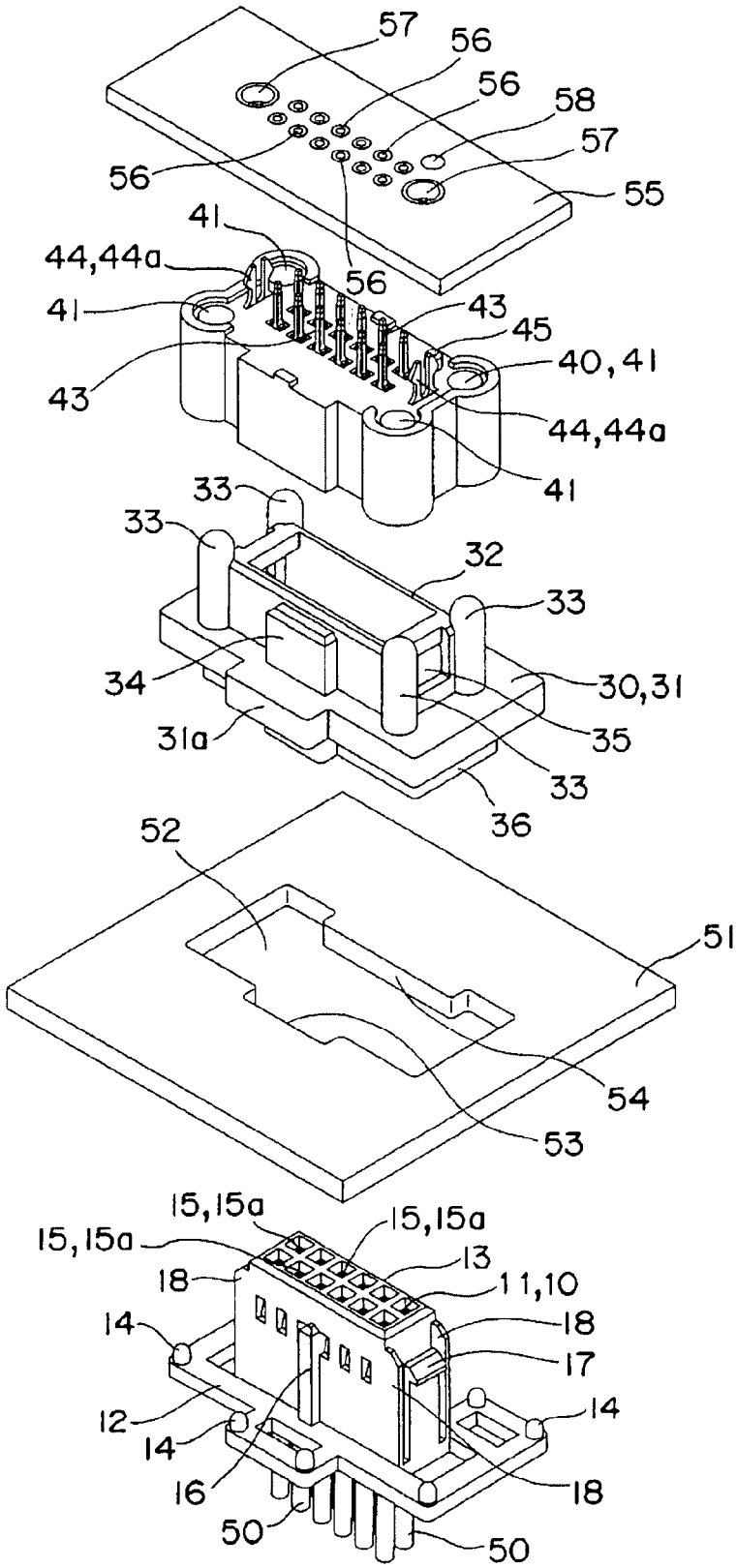
FIG. 2 shows an exploded perspective view of the first embodiment shown in FIG. 1.

The connector device according to a first embodiment is configured by a socket 10 including a socket main body 11 and a socket cover 30, and a plug 40, as shown in FIGS. 1 and 2.

Figure 3A:
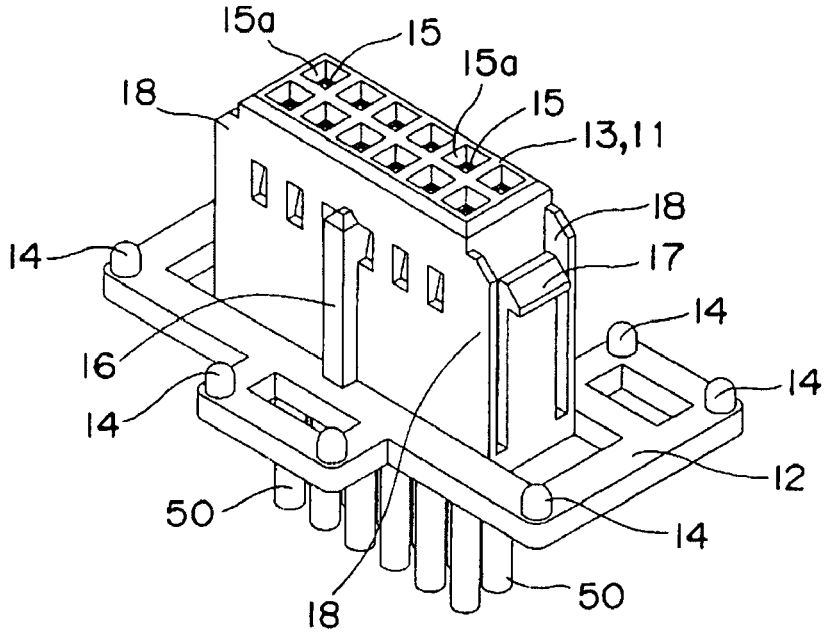
FIGS. 3A and 3B show perspective views of a socket main body shown in FIG. 2 seen from different angles.
Figure 3B:
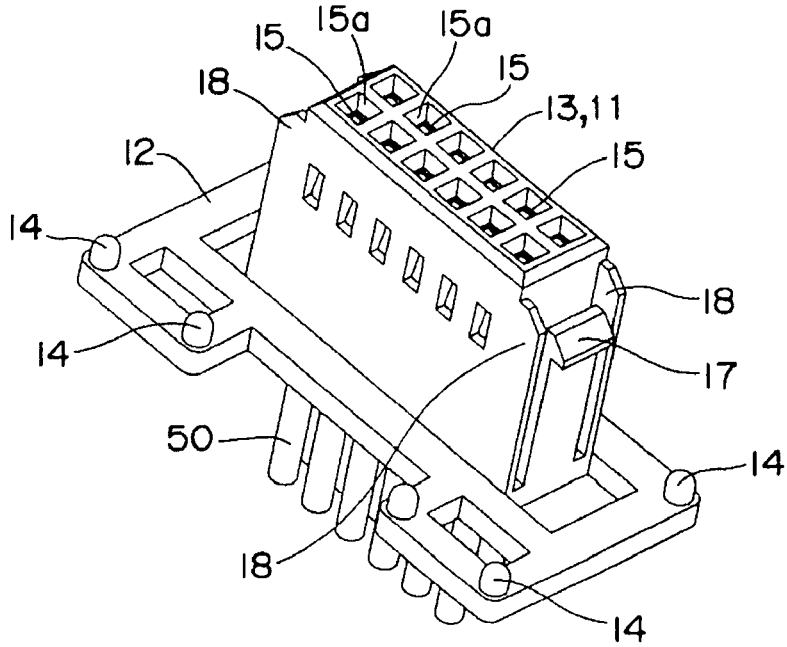
Figure 10:
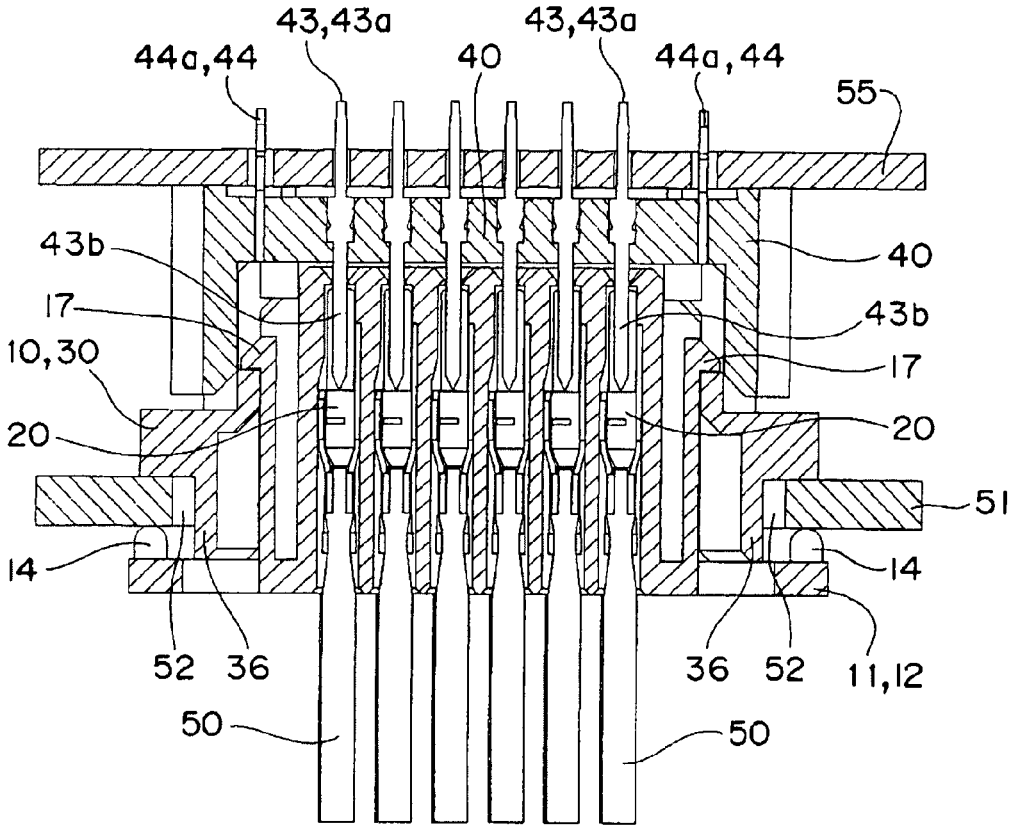
FIG. 10 shows a cross sectional view of a connection state of the socket and the plug shown in FIG. 1.

The socket main body 11 has a frame shaped collar part 12 integrally molded at the outer peripheral surface of a housing 13 having a solid rectangular shape that can be play-fitted to a fit-in hole 52 of an attachment substrate 51, to be hereinafter described, as shown in FIG. 3. A positioning projection 14 is arranged in a projecting manner at each corner of the frame shaped collar part 12. Two rows of pin holes 15 are formed at a predetermined pitch in the housing 13, and a connection pin 20, to be hereinafter described, is press fit from below into each pin hole 15 (FIG. 10). In particular, four-sided truncated pyramid guide concave parts 15*a* communicating to the pin holes 15 are formed at the upper end face of the housing 13. Furthermore, a guide rib 16 is arranged in a projecting manner at the side surface of the long side. An elastic engagement nail 17 is integrally molded at both side surfaces of the short side, and a pair of protection ribs 18 is formed at both side edges of both side surfaces.

Figure 4A:
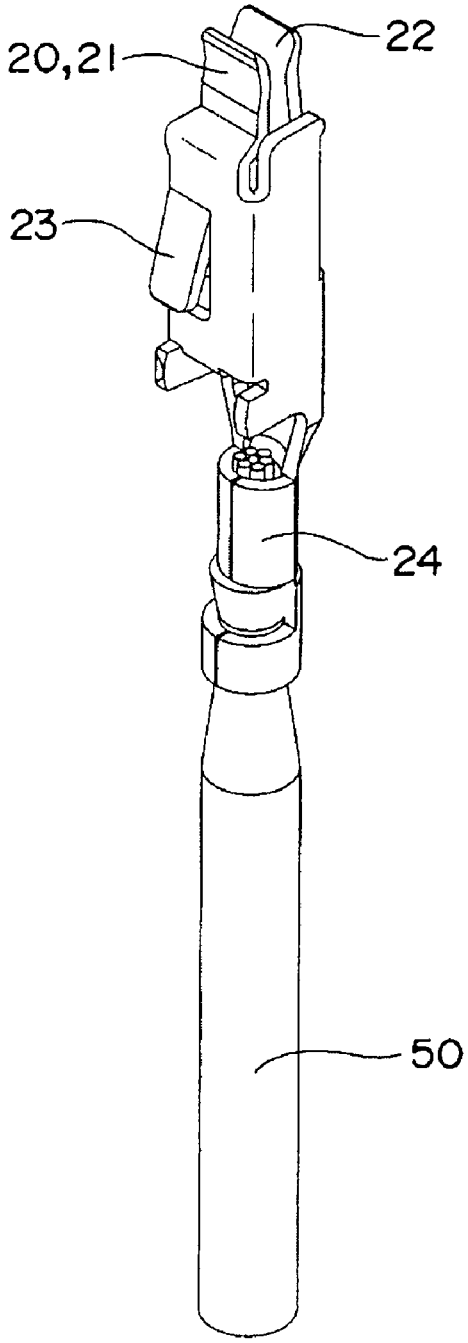
FIGS. 4A and 4B show perspective views of a connection pin incorporated in the socket main body shown in FIG. 3 and including a lead wire seen from different angles.
Figure 4B:
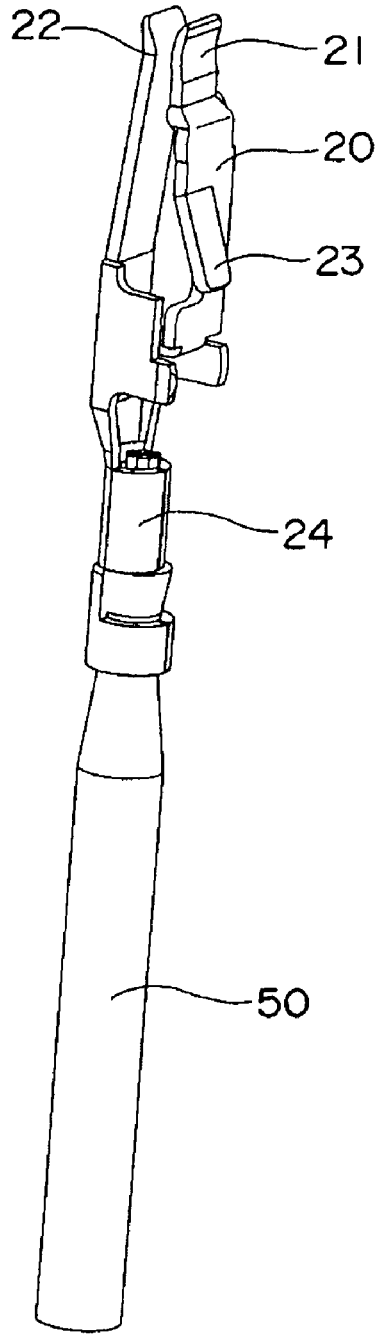

The connection pin 20 is formed by performing press work on a conductive plate member to form a pair of elastic tongue strips 21, 22 facing each other at the upper end, and a slip-preventing engagement nail 23 is raised at the basal end of one of the elastic tongue strips 21, as shown in FIG. 4. The connection pin 20 is electrically connected with a lead wire 50 by way of a caulked part 24 formed at the lower end.

Figure 5A:
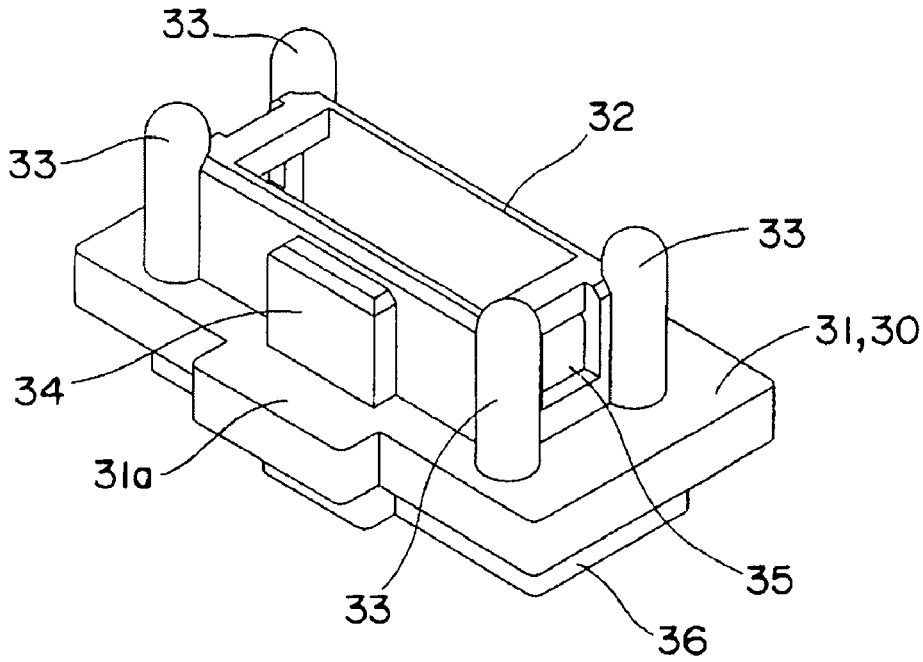
FIGS. 5A and 5B show perspective view and cross sectional perspective view of a socket cover shown in FIG. 2.
Figure 5B:
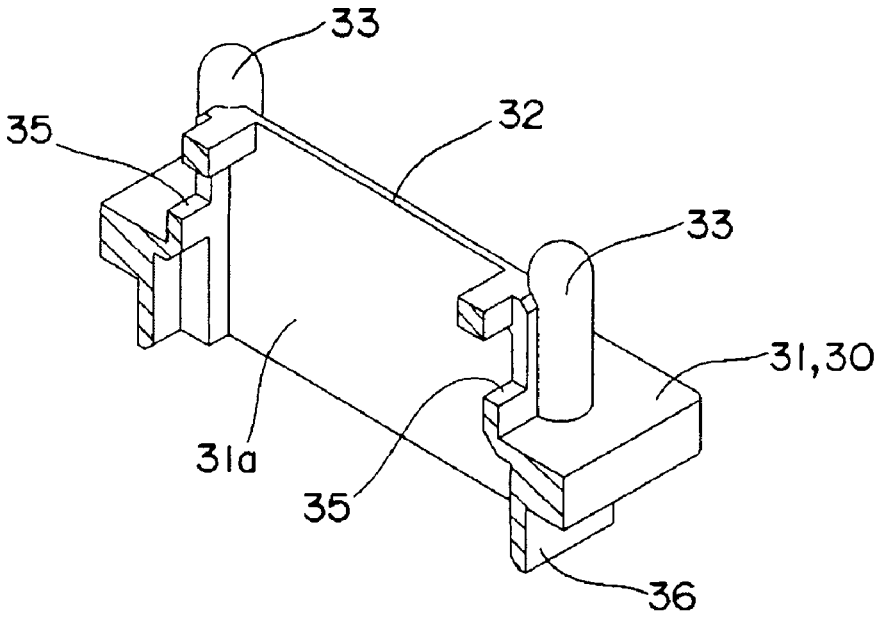
Figure 6A:
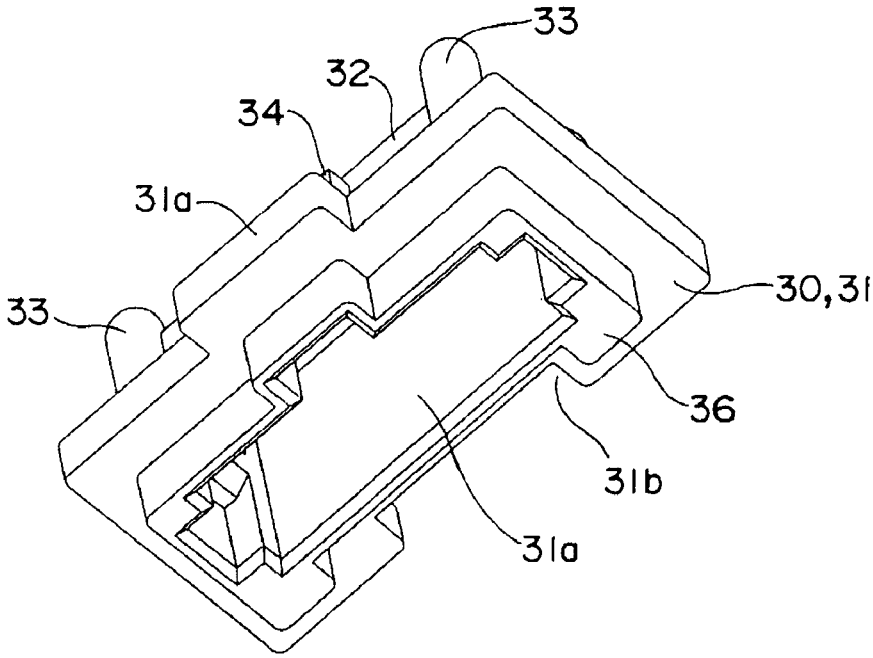
FIGS. 6A and 6B show perspective views of the socket cover shown in FIG. 2 seen from different angles.
Figure 6B:
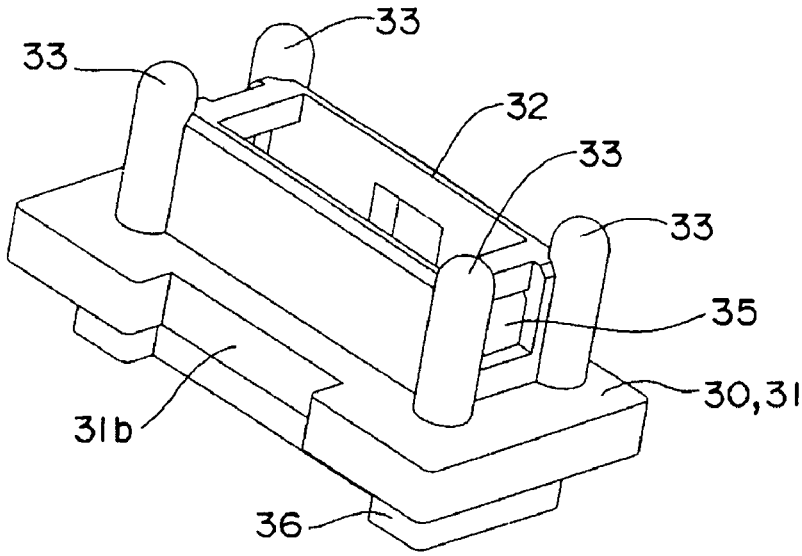

The socket cover 30 is formed with a fit-in hole 31*a* that can be fitted to the socket main body 10 at the center of a plate shaped collar part 31 formed with positioning convex part 31*a*, concave part 31*b* at the opposing outer peripheral edges, and an annular cover part 32 arranged in a projecting manner at the peripheral edge of the upper surface, as shown in FIGS. 5 and 6. The annular cover part 32 has a guide supporting column 33 integrally molded at the corner thereof, and has a fit-in rib 34 integrally molded at one side surface on the long side. An engagement hole 35 is formed at both side surfaces of the short side of the annular cover part 32. Furthermore, an annular rib 36 that can be play-fit to the attachment hole 51 of the attachment substrate 51, to be hereinafter described, is arranged in a projecting manner at the central part of the lower surface of the plate shaped collar part 31.

According to the present embodiment, die manufacturing of the socket cover 30 is facilitated, and production cost is reduced since a great number of terminal holes does not need to be formed in the socket cover 30, and only one fit-in hole simply needs to be formed.

Figure 7A:
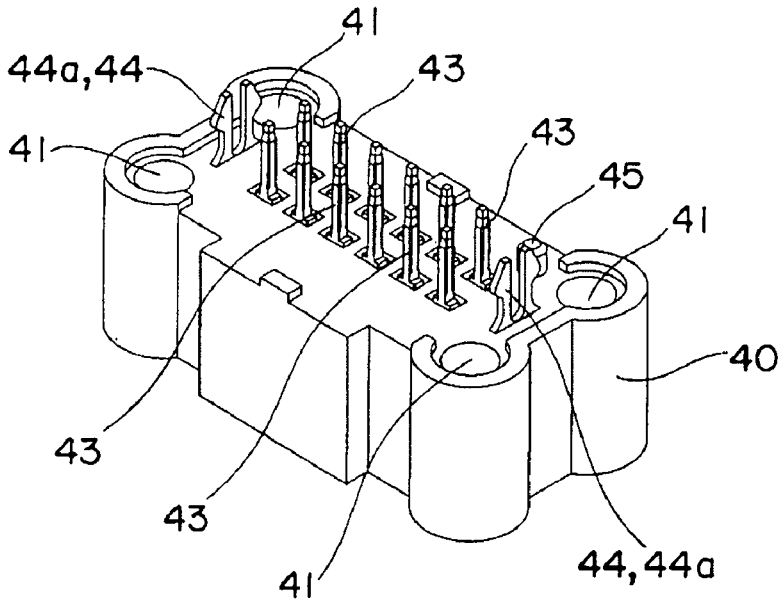
FIGS. 7A and 7B show perspective view and cross sectional perspective view of the plug shown in FIG. 2.
Figure 7B:
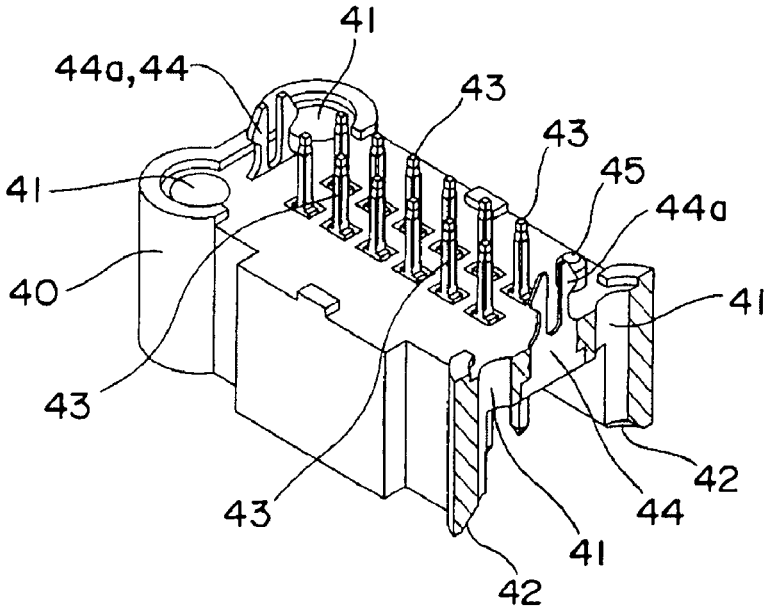
Figure 8A:
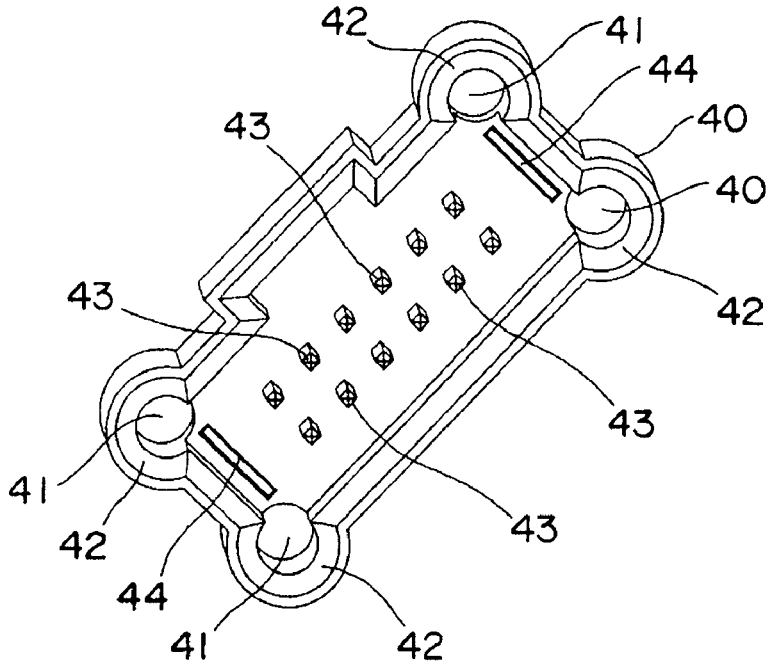
FIGS. 8A and 8B show perspective view and cross sectional perspective view of the plug shown in FIG. 2 seen from different angles.
Figure 8B:
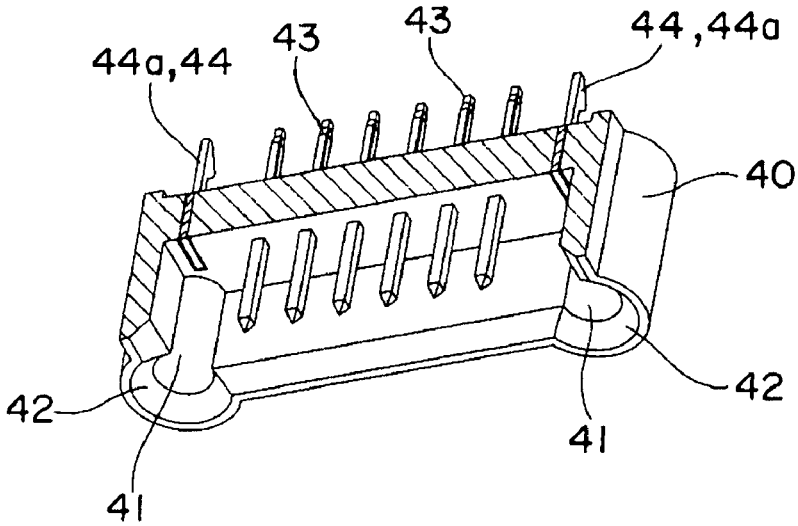
Figure 9A:
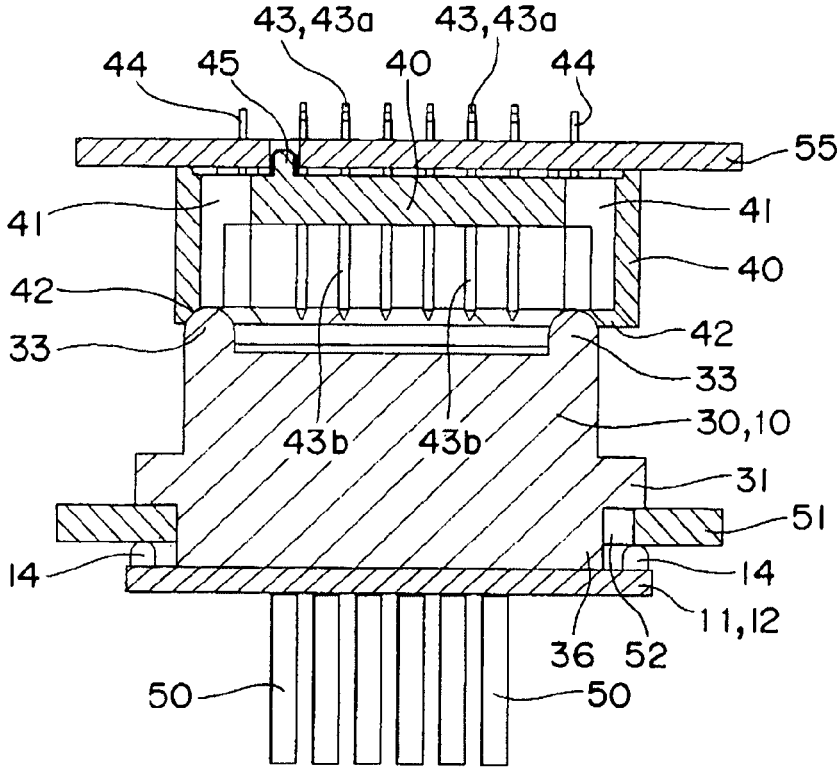
FIGS. 9A and 9B are cross sectional views for describing the method of connecting the socket and the plug shown in FIG. 1.
Figure 9B:
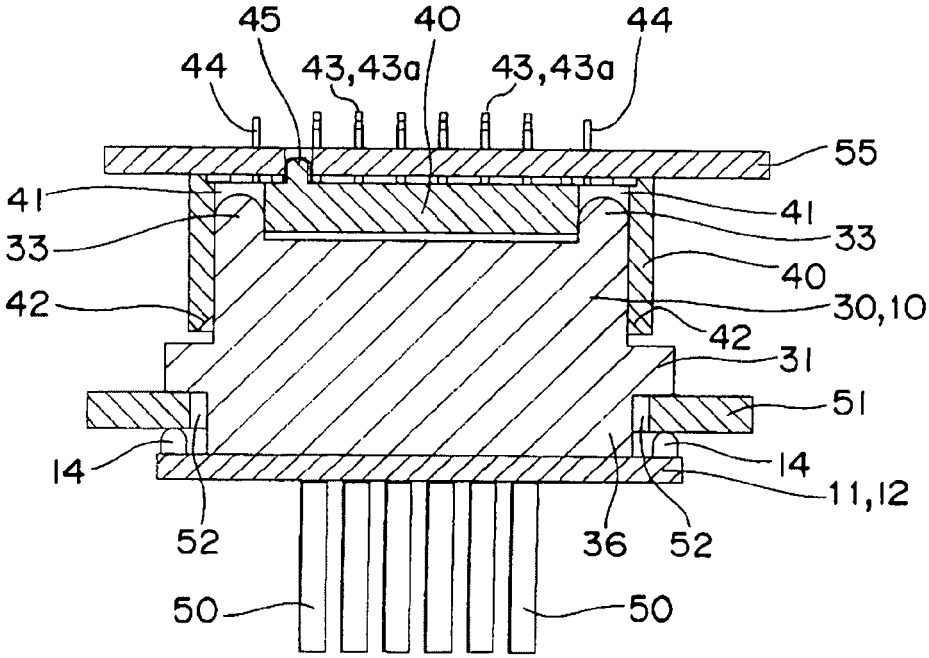

The plug 40 has an outer peripheral shape that can be fitted into the socket cover 30 and includes an insertion hole 41 to which the guide supporting column part 33 is inserted at four corners, as shown in FIGS. 7 and 8. In particular, since an annular tapered surface 42 of circular truncated pyramid shape is formed at the lower opening edge of the insertion hole 41, positioning with respect to the socket cover 30 is facilitated, and the assembly work is facilitated. Furthermore, the plug 40 has the press-fit pins 43 arranged at a predetermined pitch on the top surface, and also has engagement pins 44 arranged thereon. Elastic engagement parts 44*a*, 44*a* branched into two are formed at the upper end of the engagement pin 44. A positioning projection 45 is arranged in a projecting manner from the upper end face of the plug 40.

The method of connecting the socket 10 and the plug 40 will now be described based on FIGS. 2, 9, and 10.

First, the annular rib 36 of the socket cover 30 is fitted from the upper side and positioned in the attachment hole 52 of the attachment substrate 51 formed with a concave part 53 and a convex part 54 at the opposing opening edges. The housing part 13 of the socket main body 11 is then inserted from the lower side to the fit-in hole 31*a* of the socket cover 30, where the elastic engagement nail 17 arranged on the housing part 13 engages the engagement hole 35 formed in the socket cover 30 so that the attachment substrate 51 is slidably sandwiched between the frame shaped collar part 12 of the socket main body 11 and the plate shaped collar part 31 of the socket cover 30. The guide concave parts 15*a* of the socket main body 11 are exposed from the opening of the annular cover 32 of the socket cover 30, but the exposed surface is lowered by one step from the opening edge of the annular cover 32.

As shown in FIG. 2, the terminals 43*a* of the press-fit pins 43 of the plug 40 are inserted to the terminal holes 56 of the print substrate 55, the elastic engagement parts 44*a*, 44*a* of the engagement pins 44, 44 are elastically engaged to the engagement hole 57 of the print substrate 55, and the positioning projection 45 of the plug 40 is inserted to the positioning hole 58.

As shown in FIG. 1, assembling is performed after positioning the insertion holes 41 of the plug 40 above the guide supporting columns 33 of the socket 10 slidably attached to the attachment substrate 51. The upper ends of the guide supporting columns 33 are guided by the annular tapered surface 42 of the insertion hole 41 (FIG. 9A), so that the socket 10 is sled and automatically position adjusted. Thus, the guide supporting columns 33 are inserted to the insertion holes 41 (FIG. 9B), and the press-fit parts 43*b* of the press-fit pins 43 are press fit between the elastic tongue strips 21 and 22 of the connection pin 20, and electrically connected (FIG. 10). Here, since the exposed surface or the upper end face of the socket main body 11 is one step lower from the opening of the annular cover 32 of the socket cover 30, positioning work is facilitated and thus work becomes easier.

Figure 11A:
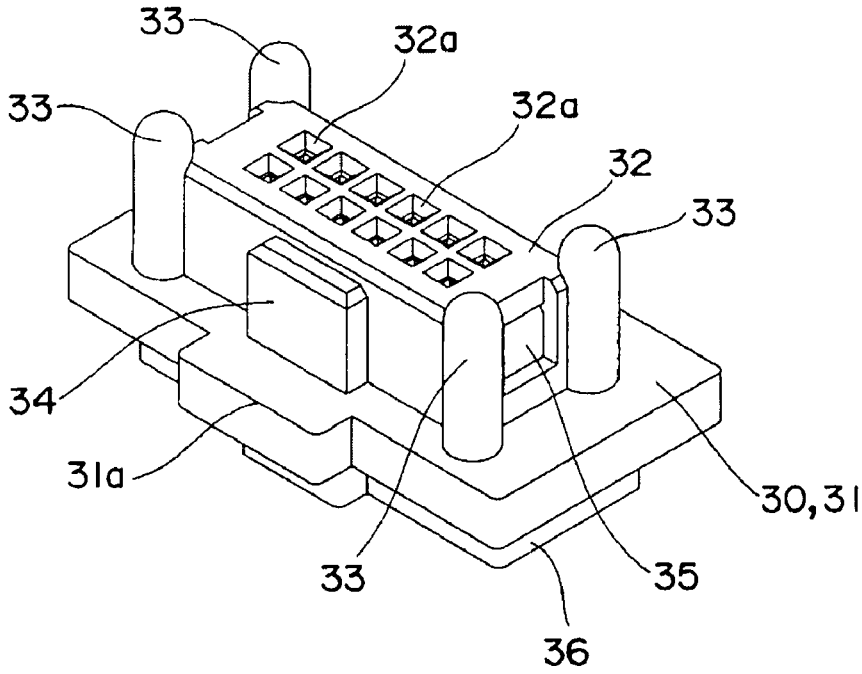
FIGS. 11A and 11B show perspective views of a socket cover and a socket main body showing a second embodiment of the connector device according to the present invention.
Figure 11B:
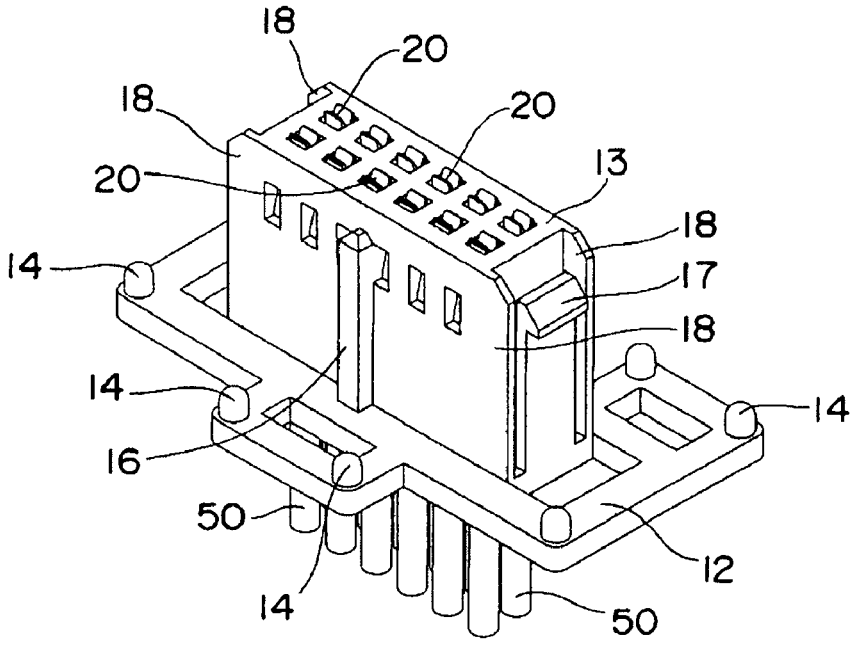

The socket 10 according to the second embodiment is substantially the same as in the first embodiment and differs in the fit-in structure of the socket cover 30 and the socket main body 11, as shown in FIG. 11.

That is, in the present embodiment, the guide concave parts 32*a* of four-sided truncated pyramid communicating to the pin holes 15 of the socket man body 15 are formed in the top surface of the socket cover 30 at a predetermined pitch, and the guide concave part of the socket main body 11 is eliminated so that the upper end of the connection pin 20 is exposed. Same reference characters are denoted for the same components, and the description thereof will be omitted.

According to the present embodiment, the strength of the socket cover 30 enhances since the upper end face of the socket cover 30 is not merely an opening but has a frame shape.

Figure 12:
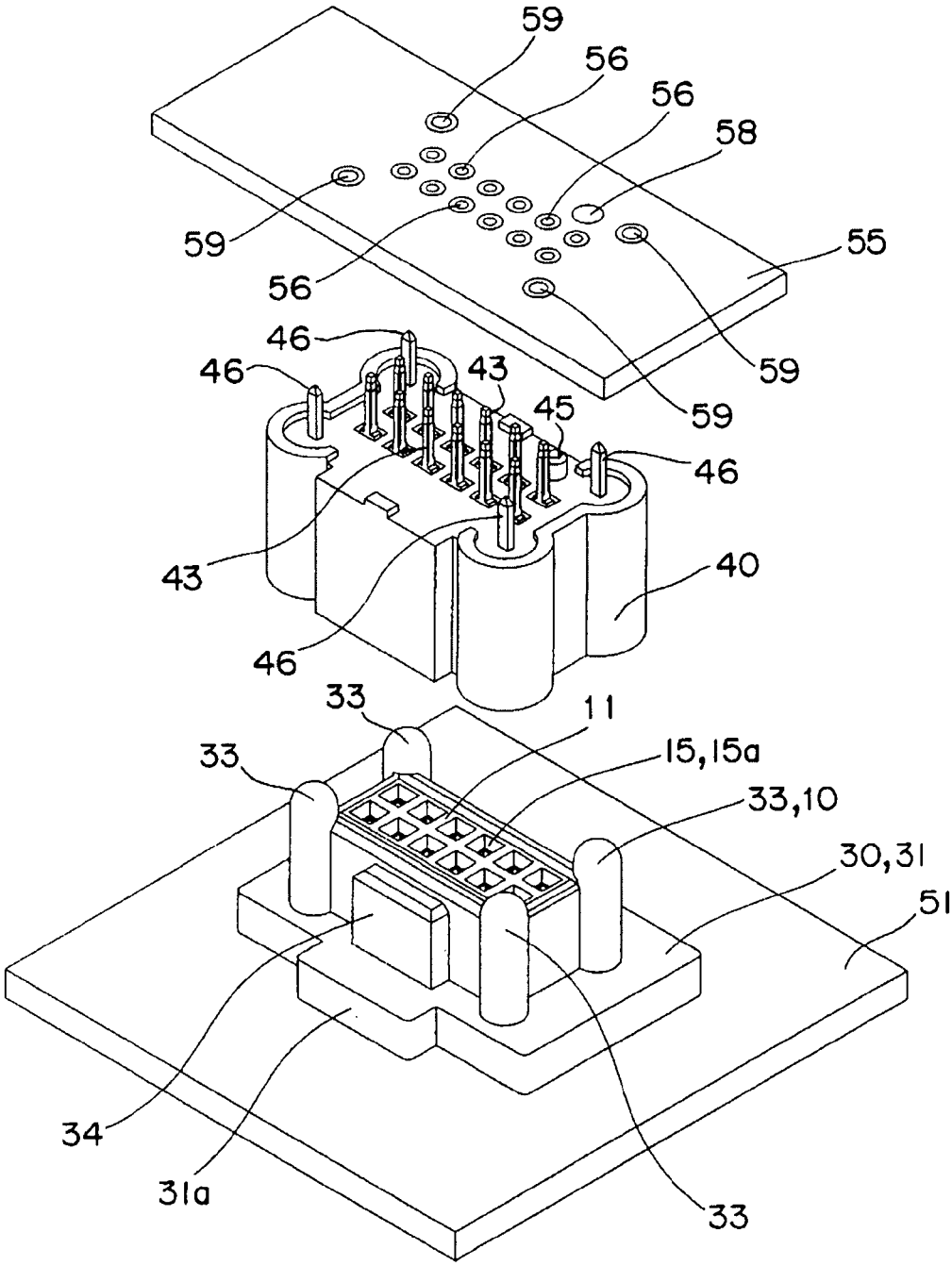
FIG. 12 shows an exploded perspective view showing a third embodiment of the connector device according to the present invention.
Figure 13A:
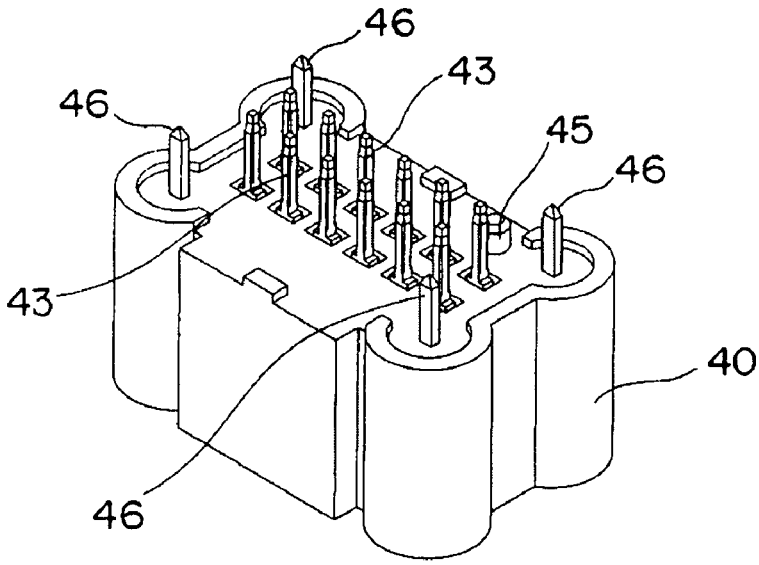
FIGS. 13A and 13B are perspective view and cross sectional perspective view of the plug shown in FIG. 12.
Figure 13B:
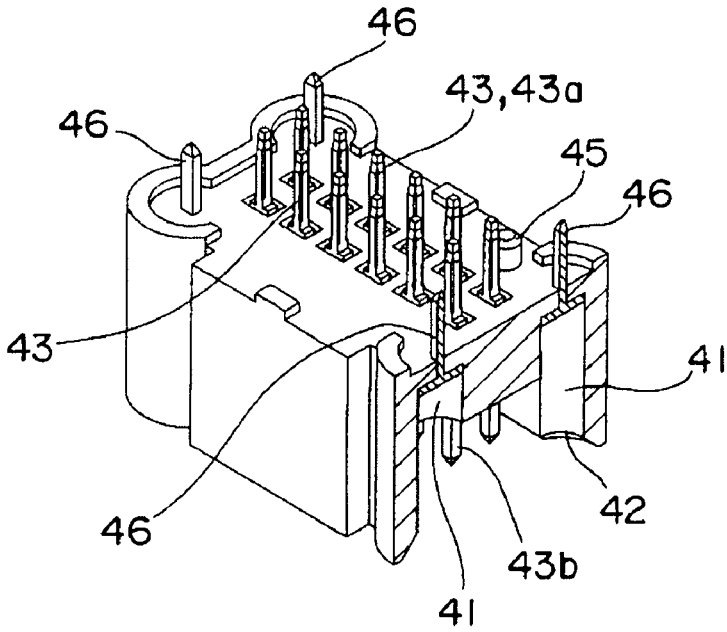
Figure 14A:
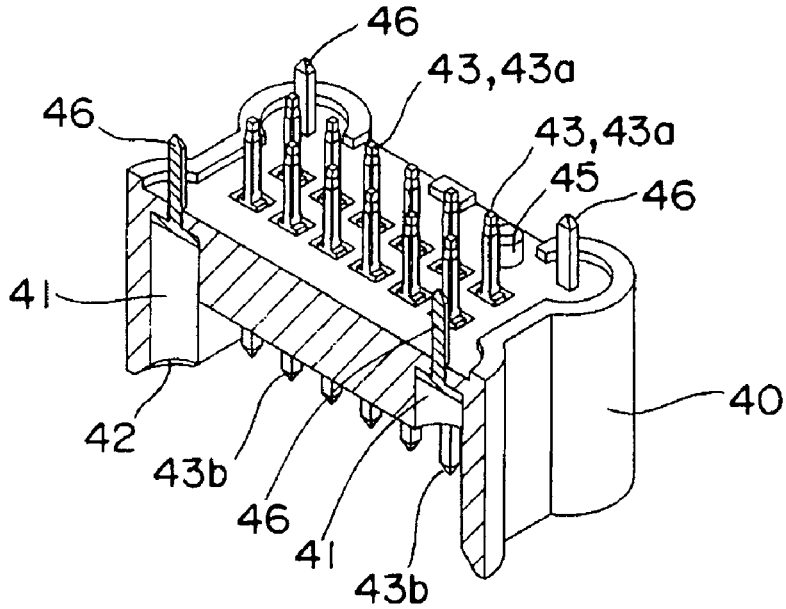
FIGS. 14A and 14B show cross sectional perspective views of the plug shown in FIG. 12.
Figure 14B:
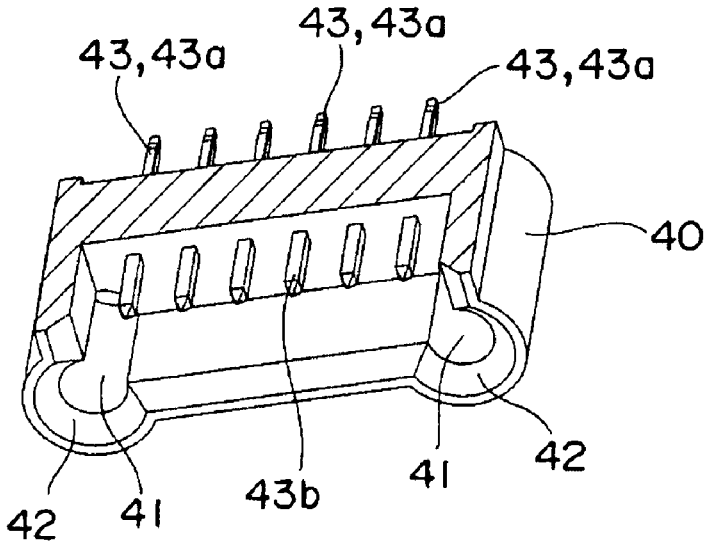

The third embodiment is substantially the same as the first embodiment but differs in the attachment structure of the plug 40 with respect to the print substrate 55, as shown in FIGS. 12 to 14.

That is, the plug 40 according to the present embodiment has the engagement pin 46 arranged in a projecting manner at the corners of the upper end face.

According to the present embodiment, the connector having a smaller floor area is obtained since the space of the fit-in insertion hole 41 is also used as the substrate attachment space.

The engagement pin 44 according to the first embodiment may be arranged at four corners of the plug 40 to be engaged and integrated.

Figure 15:
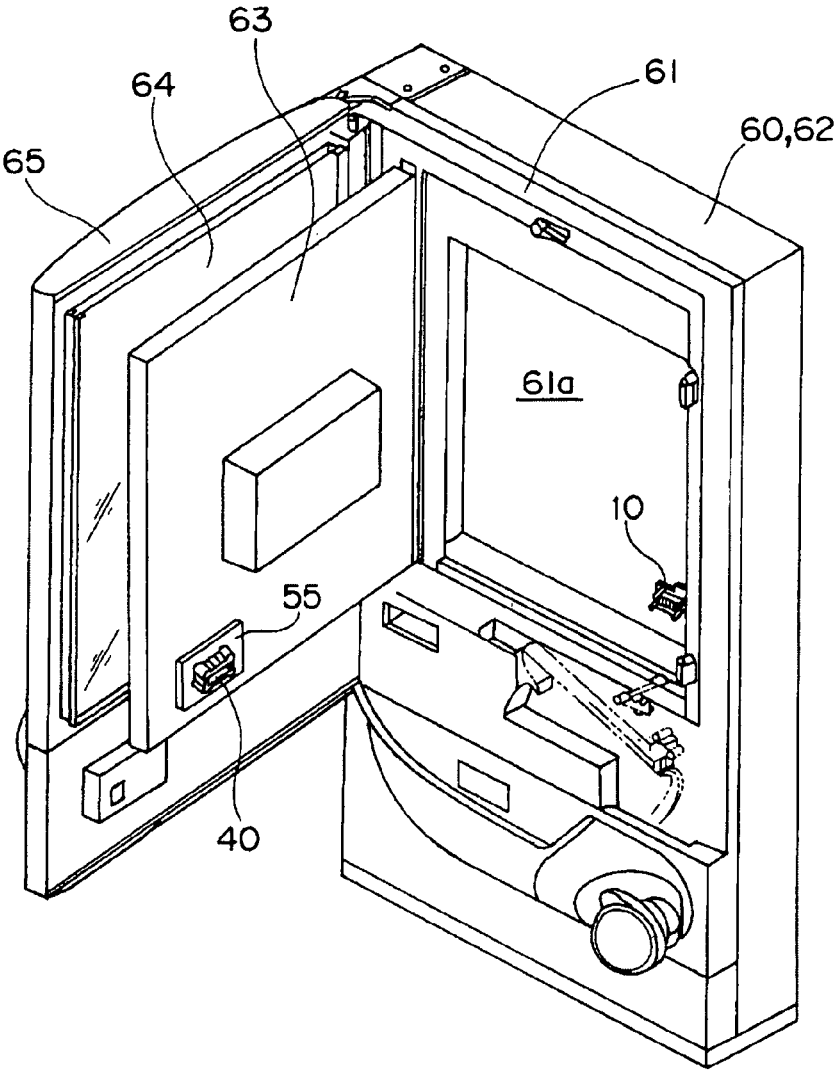
FIG. 15 shows a schematic perspective view showing a fourth embodiment applied to a pinball game machine.
Figure 16:
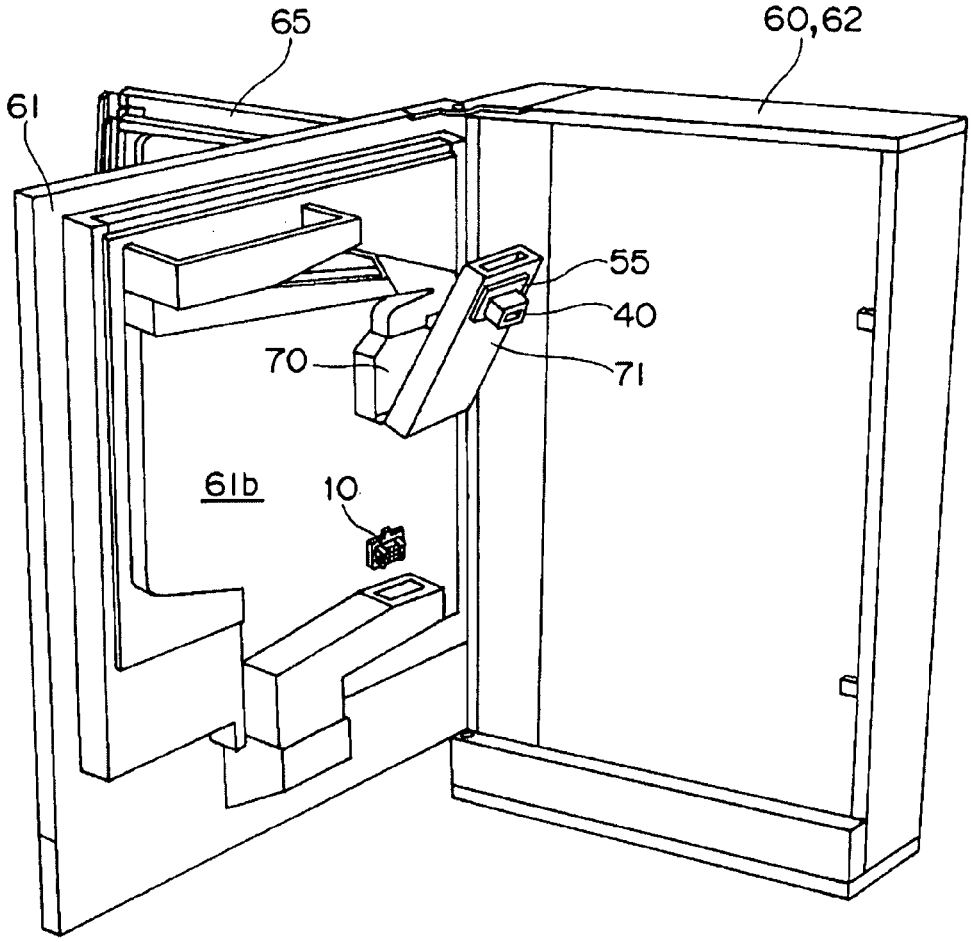
FIG. 16 shows a schematic perspective view showing a fifth embodiment applied to a ball discharging unit of the pinball game machine.

The fourth embodiment shows a case where the connector device according to the previous embodiments is applied to electrical connection of the pinball game machine 60, as shown in FIG. 15.

In the pinball game machine 60 according to the present embodiment, the pinball game machine main body 61 is hinge supported at the machine frame 62, and the play board 63 is rotatably supported on the front surface side of the pinball game machine main body 61. Furthermore, a glass door frame 65 attached with a transparent glass 64 is hinge supported at the front side of the play board 63.

According to the present embodiment, the socket 10 is slidably attached to the attachment plate 61*a* of the front surface side of the pinball game machine main body 61, and the plug 40 is attached to the rear surface of the play board 63 by way of the print substrate 55. Thus, even if the assembly accuracy of the play board 63 with respect to the pinball game machine main body 61 is low, the plug 40 can be fitted into the socket 10 as the socket 10 is sled and position adjusted on the attachment plate 61*a*. As a result, the connection workability at the site is facilitated, skilled person is not necessary, and pinball game machine 60 having high productivity is obtained.

The fifth embodiment shows a case where the connector device according to the previous embodiments is applied to a ball discharging unit 70 of the pinball game machine 60.

The ball discharging unit 70 arranged on the rear surface side of the pinball machine main body 61 has ball feeding tubular body 71 of one part thereof rotatably hinge supported with respect to the attachment plate 61*b*. The plug 40 is attached to the front surface side of the ball feeding tubular body 71 by way of the print substrate 55. The socket 10 is slidably attached to the attachment plate 61*b* arranged on the rear surface side of the pinball machine main body 61.

According to the present embodiment, the plug 40 is fitted into the socket 10 and electrically connected even if the attachment accuracy of the plug 40 with respect to the ball feeding tubular body 71 is low since the socket 10 is sled and position adjusted. Thus, similar to the fourth embodiment, even if the attachment accuracy is low, the connection task at the site is facilitated, skilled person is not necessary, and pinball game machine 60 having high productivity is obtained.

The connector device according to the present invention is not limited to applications to pinball game machine and pachinko-slot game machine, and may obviously be applied to the connection of other electrical equipments.

What is claimed is:

1. A connector device for fitting and electrically connecting a plug to a socket, the socket including a socket main body and a socket cover attached to an attachment substrate, wherein the socket main body and the socket cover are assembled from opposite directions to an attachment hole of the attachment substrate such that the attachment substrate is sandwiched by a collar part of the socket main body and a collar part of the socket cover, the socket main body and the socket cover are slidably supported in an integrated manner, the socket main body comprises an annular cover having an opening, and an upper end face of the socket main body is lower than an uppermost portion of the opening of the annular cover.

2. A connector device according to claim 1, wherein the socket main body and the socket cover are removably engaged and integrated from opposite directions to an attachment hole of the attachment substrate such that the attachment substrate is sandwiched by a collar part of the socket main body and a collar part of the socket cover, and the socket main body and the socket cover are slidably supported in an integrated manner.

3. A connector device according to claim 1, wherein a plurality of positioning projections contacting at least one surface of the attachment substrate is arranged in a projecting manner on the collar part of the socket main body and/or socket cover.

4. A connector device according to claim 1, wherein the socket is slidably attached to an attachment plate arranged on a front surface of a pinball game machine main body, and a plug is attached to a rear surface of a game board arranged on the front surface side of the attachment plate at a position facing the socket, and the plug is fitted into and electrically connected to the socket.

5. A connector device according to claim 1, wherein the socket is slidably attached to an attachment plate arranged on a rear surface of a pinball game machine main body, and a plug is attached to a ball discharging unit arranged on a rear surface side of the pinball game machine main body at a position facing the socket, and the plug is fitted into and electrically connected to the socket.

6. A connector device according to claim 2, wherein a plurality of positioning projections contacting at least one surface of the attachment substrate is arranged in a projecting manner on the collar part of the socket main body and/or socket cover.

7. A connector device according to claim 2, wherein the socket is slidably attached to an attachment plate arranged on a front surface of a pinball game machine main body, and a plug is attached to a rear surface of a game board arranged on the front surface side of the attachment plate at a position facing the socket, and the plug is fitted into and electrically connected to the socket.

8. A connector device according to claim 2, wherein the socket is slidably attached to an attachment plate arranged on a rear surface of a pinball game machine main body, and a plug is attached to a ball discharging unit arranged on a rear surface side of the pinball game machine main body at a position facing the socket, and the plug is fitted into and electrically connected to the socket.

* * * * *